US005622598A

United States Patent [19]

Prough

[11] Patent Number: 5,622,598

[45] **Date of Patent: *Apr. 22, 1997**

[54] CHIP PUMPING TO A DIGESTER

[75] Inventor: J. Robert Prough, Queensbury, N.Y.

[73] Assignee: Ahlstrom Machinery Inc., Glens Falls, N.Y.

[ * ] Notice: The term of this patent shall not extend beyond the expiration date of Pat. No. 5,476,572.

[21] Appl. No.: 428,302

[22] Filed: Apr. 25, 1995

[51] Int. Cl.[6] ..... D21C 7/06; D21C 7/08

[52] U.S. Cl. ..... 162/52; 162/238; 162/246; 162/248

[58] Field of Search ..... 162/52, 246, 248, 162/251, 375, 238

[56] References Cited

U.S. PATENT DOCUMENTS

| | | | |
|---|---|---|---|
| 3,303,088 | 2/1967 | Gessner | 162/19 |
| 4,032,391 | 6/1977 | Moked et al. | 159/47 R |
| 4,372,711 | 2/1983 | Richter et al. | 406/63 |
| 4,958,741 | 9/1990 | Johanson | 220/83 |
| 5,236,285 | 8/1993 | Prough | 406/52 |
| 5,236,286 | 8/1993 | Prough | 406/52 |

FOREIGN PATENT DOCUMENTS

| | | |
|---|---|---|
| 1154622 | 10/1983 | Canada . |
| 1302764 | 6/1992 | Canada . |
| 324949 | 6/1970 | Sweden . |

*Primary Examiner*—Donald E. Czaja
*Assistant Examiner*—Dean T. Nguyen
*Attorney, Agent, or Firm*—Nixon & Vanderhye P.C.

[57] ABSTRACT

A system for feeding wood chips entrained in cooking liquor to a high pressure feeder connected to a continuous digester includes a vertical treatment (e.g. steaming) vessel, a metering device connected to the discharge from the steaming vessel, a generally vertical chip chute extending downwardly from the metering device, and a slurry pump having an inlet. The slurry pump pumps the slurry from an outlet thereof to a high pressure feeder low pressure inlet. In order to minimize the effect of changes in liquid volume upon the operation of the system, and to provide separate control of liquor volume and chip volume, a substantially vertical liquor tank having a top and bottom the bottom including a discharge opening above the slurry pump inlet is provided. A conduit directly connects the liquor tank discharge opening with the slurry pump inlet. A pressure isolating device may be used in the system if it is to operate at superatmospheric pressure rather than atmospheric pressure.

21 Claims, 4 Drawing Sheets

CHIP PUMPING TO A DIGESTER

BACKGROUND AND SUMMARY OF THE INVENTION

In U.S. Pat. No. 5,476,572 and in co-pending U.S. application Ser. No. 08/354,005, filed Dec. 5, 1994 (the disclosures of which are incorporated by reference herein), novel methods and systems are disclosed for feeding comminuted cellulose fibrous material to a continuous digester by means of a chip slurry pump. These inventions vastly reduce the size and cost of conventional feeding systems. Although these systems can effectively feed a slurry of chips and liquor to a digester, they may not be able to withstand changes in slurry liquor volume in the chute preceding the pump.

In the system of the co-pending applications, the chip and liquor slurry passes from a metering device through a conduit, i.e., a chute, directly to the slurry pump. However, small changes in the liquid volume of the slurry can result in gross changes in the height of the liquid level in the relatively narrow chute. The chute diameter/width is preferably narrow to ensure a high slurry velocity in the chute. A high velocity minimizes the potential for chips floating in the chute and ensures a more uniform feed to the pump. The present invention minimizes the effect of changes in liquid volume upon the operation of such a system while providing an advantageous system and method for preferentially varying the liquid level in the feed system. The present invention also permits the separate control of liquor volume and chip volume in a feed system in which chips are pumped.

One aspect of the invention relates to a system for feeding comminuted cellulose material entrained in liquid to a high pressure feeder connected to a digester (preferably a continuous digester). The system comprises the following components: A vertical pretreatment (e.g. steaming) vessel having a discharge at the bottom thereof. A metering device connected to the discharge of the steaming vessel. A generally vertical chute extending downwardly from the metering device. A slurry pump for pumping a slurry of comminuted cellulosic material in liquid, the slurry pump having an inlet, and the pump connected to a high pressure feeder. The chute operatively connected to the slurry pump inlet. A substantially vertical liquor tank having a top and a bottom, the bottom including a discharge opening therein. And, a conduit directly connecting the liquor tank discharge opening with the slurry pump inlet. Preferably the liquor tank is in direct communication with the chute, and through the chute the metering device in the steaming vessel, through the discharge opening in the liquor tank bottom. Means are also preferably provided for maintaining a predetermined liquid level in the liquor tank, which in turn maintains a liquid level in the metering device and steaming vessel.

The metering devices may comprise a wide variety of structures, such as a conventional chip meter (having a star feeder configuration), a submerged chip meter, a metering screw, or the like. The system may be maintained substantially at atmospheric pressure, or it may a superatmospheric pressure system, in which case an isolating device (such as a low pressure feeder) is provided between the steaming vessel and the slurry pump for isolating the slurry pump from the atmosphere and for maintaining the slurry pump at superatmospheric pressure. For example a low pressure feeder may be provided between the steaming vessel and the metering device, or at other locations such as between the metering device and the feed chute, or even between the feed chute and the inlet to the slurry pump.

The system is also preferably provided in combination with a high pressure feeder having a low pressure inlet, low pressure outlet, high pressure inlet connected to a high pressure pump, and high pressure outlet. The slurry pump is connected to the low pressure inlet of the high pressure feeder, and the high pressure outlet is connected to the digester, e.g. the top of a continuous digester.

The system may also further comprise an in-line drainer, a level tank, a valve that is always at least partially open, a first recirculation conduit connecting the low pressure outlet to the drainer, a second conduit connecting the drainer to the level tank so that liquid drained from the drainer passes into the level tank; and a third recirculation conduit connecting the drainer to the discharge opening at the bottom of the liquor tank.

The steaming vessel may be of a wide variety of configurations. Preferably, however, either it or an outlet from the metering device or the feed chute, includes a single convergent outlet with side relief, such as shown in co-pending application Ser. No. 08/189,546 filed Feb. 1, 1994 now U.S. Pat. No. 5,500,083 and Ser. No. 08/366,581 filed Dec. 30, 1994, the disclosures of which are incorporated by reference herein. While the preferred pretreatment vessel is a steaming vessel, other vessels can be utilized to pretreat the chips or other cellulose material with a cooking liquor (such as kraft white liquor, black liquor, green liquor, sulfite liquor, or soda liquor), or to pretreat it with anthraquinone (or its derivatives or equivalents), or sulfide enhancing additives (such as polysulifide or NaSH, or hydrosulfide gas) or simply with hot water.

According to another aspect of the present invention a method of feeding a slurry of comminuted cellulosic fibrous material (such as wood chips) in liquid (such as cooking liquor like white liquor) to a digester is provided, which utilizes a pretreatment vessel, high pressure feeder having a low pressure inlet, and slurry pump having an inlet. The method comprises the steps of: (a) Pretreating the comminuted cellulosic fibrous material in the pretreatment vessel. (b) Metering the flow of comminuted cellulosic fibrous material from the pretreatment vessel. (c) Entraining the metered comminuted cellulosic fibrous material in liquid to form a slurry. (d) Feeding the slurry to the inlet to the slurry pump. (e) Providing a separate supply of liquid to the slurry pump to facilitate the transfer of comminuted cellulosic fibrous material to the pump. (f) Transporting the slurry under the influence of the slurry pump to the low pressure inlet to the high pressure feeder. And, (g) feeding the comminuted cellulosic fibrous material with the high pressure feeder to a digester. The preferred pretreatment is steaming, but other treatments—as described above with respect to the pretreatment vessel (e.g. with polysulfide)—may be provided instead of or in addition to presteaming.

Step (e) is preferably practiced by connecting an open bottom discharge from a substantially vertical liquid tank that is higher than the slurry pump inlet directly to the slurry pump inlet. There is also preferably the further step of maintaining a liquid level in the substantially vertical liquid tank, and providing an open connection between the vertical liquid tank open bottom discharge and the steaming vessel so as to provide the same liquid level in the steaming vessel. Steps (c) and (d) are typically practiced to entrain the cellulose material in cooking liquor.

According to yet another aspect of the present invention a slurry feeding system for feeding a slurry of comminuted cellulosic fibrous material in liquid to a digester is provided. The system comprises the following components: A substantially vertical pretreatment vessel. Means for metering the flow of comminuted cellulosic fibrous material from the pretreatment vessel. Means for entraining the metered comminuted cellulosic fibrous material in liquid to form a slurry. A slurry pump having an inlet. Means for feeding the slurry to the inlet to the slurry pump. Means providing a separate supply of liquid to the inlet to the slurry pump to facilitate the transfer of comminuted cellulosic fibrous material to the slurry pump to permit separate control of liquor and comminuted cellulosic material volumes, and to minimize the effect of changes in liquid volume upon operation. A high pressure feeder having a low pressure inlet and a high pressure outlet. Means for transporting the slurry under the influence of the slurry pump to the low pressure inlet of the high pressure feeder. And, means for transporting the comminuted cellulosic fibrous material from the high pressure feeder to a digester. The means for providing a separate supply of liquid preferably comprises a substantially vertical liquid tank having an open bottom discharge that is higher than the slurry pump inlet, and connected directly to the slurry pump inlet. This invention also preferably includes a means for thermally separating liquors between the high-pressure transfer device and the digester.

It is the primary object of the present invention to provide a system and method which accommodate variations in liquor volume for the advantageous feeding of comminuted cellulosic fibrous material slurry to a digester, retaining all of the other advantages of the structures of co-pending application Ser. No. 08/354,005 and U.S. Pat. No. 5,476,572, incorporated by reference herein, including utilization of the high pressure feeder at ground level. This and other objects of the invention will become clear from an inspection of the detailed description of the invention, and from the appended claims.

DETAILED DESCRIPTION OF THE DRAWINGS

Figure 1:
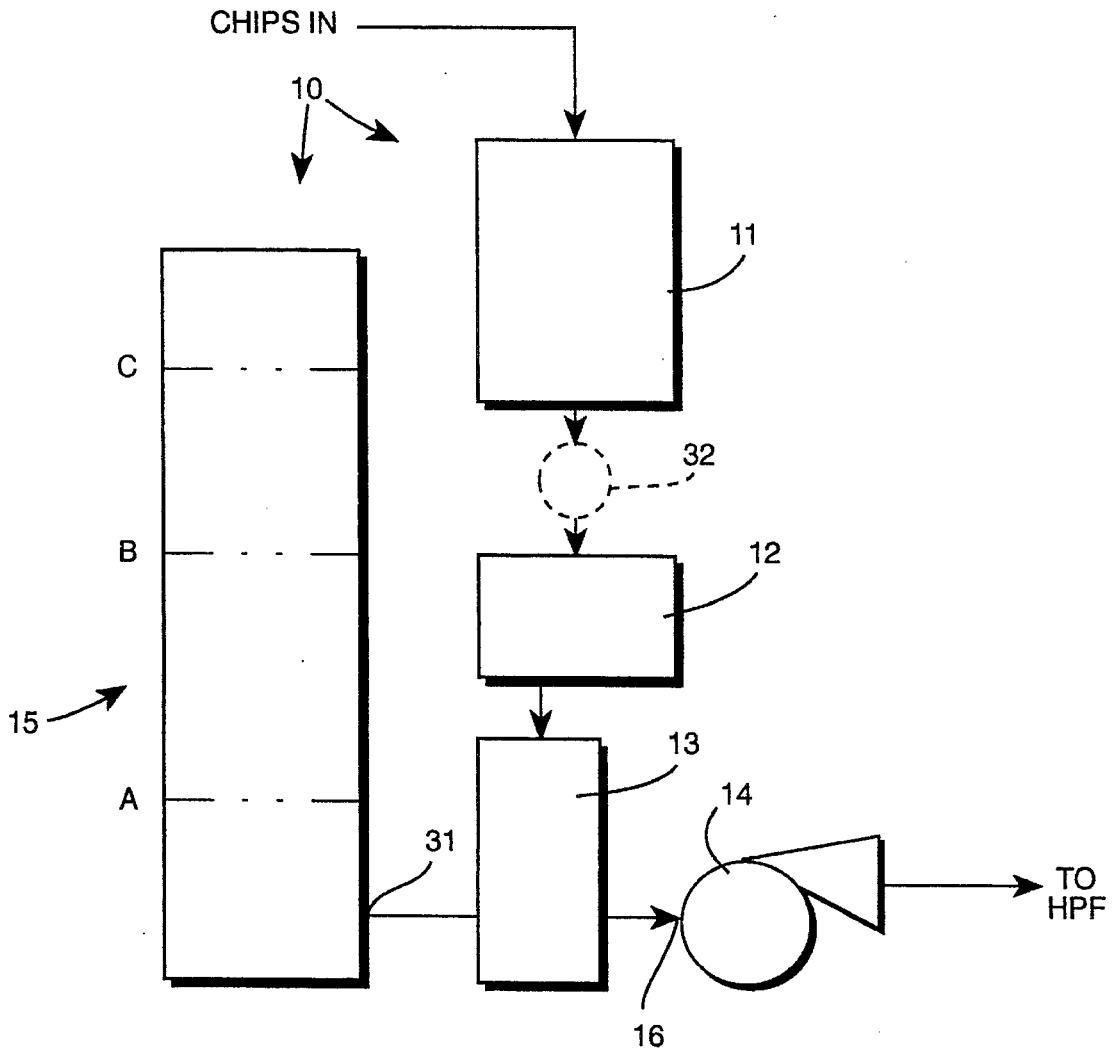
FIG. 1 is a schematic view of an exemplary system according to the present invention.

FIG. 1 shows a schematic of the general feeding system 10 of the invention. This system includes a preferably substantially vertical pretreatment (preferably steaming) vessel 11, metering device 12, a feed chute 13 and a slurry pump 14. The significant feature that distinguishes the system 10 from the prior art is the liquor level tank or liquor surge tank 15. This level tank 15 provides the necessary source of liquor for feeding the slurry pump 14 to ensure that liquor is always present at the intake or inlet 16 to the pump 14 regardless of the variation in process conditions in the system 10. For example, should the supply of chips and liquor from he metering device 12 be interrupted, the liquor level tank 15 will provide the necessary liquor to ensure continuous and proper operation of the pump 14.

Furthermore, since variations in liquor volume are accommodated by the liquor tank, the liquor volume variation does not have to be accommodated in the feed chute 13. The diameter/width of the chute can be kept narrow to ensure a sufficiently high slurry velocity.

The level tank 15 also provides for variation in the liquor level in the feed system 10. For example, at liquor level A in FIG. 1 the inlet 16 to the slurry pump 14 is submerged and a liquor level exists in the feed chute 13. At level B, the metering device 12, chute 13 and pump 14 are submerged. The metering device 12 may be partially submerged with a liquor level in or above the device. At level C, the metering device 12, feed chute 13, and slurry pump 14 are all submerged and a liquor level also exists in the steaming vessel 11.

The steaming vessel 11 may be a conventional chip bin but is preferably a bin with a single-convergence outlet with side relief, without any mechanical rotating or vibrating discharge device, as disclosed in co-pending applications Ser. No. 08/189,546 filed Feb. 1, 1994 now U.S. Pat. No. 5,500,083 and Ser. No. 08/366,581 filed Dec. 30, 1994. Of course, when the vessel 11 is a steaming vessel it steams the chips or other cellulosic, comminuted material prior to further treatment. However, other pretreatment vessels, which practice other pretreatment steps, may be provided instead of or in addition to a steaming vessel. For example, the chips may be pretreated with cooking liquor such as kraft white liquor, black liquor, green liquor, sulfite liquor, or soda liquor, or the pretreatment may include only (or in combination with other treatment chemicals) anthraquinone (or its derivatives or equivalents). Alternatively or in addition pretreatment may be effected by using sulfide enhancing additives such as polysulfide, sodium hydrosulfide, or hydrosulfide gas; or pretreatment in vessel 11 may simply be with hot water.

Figure 3:
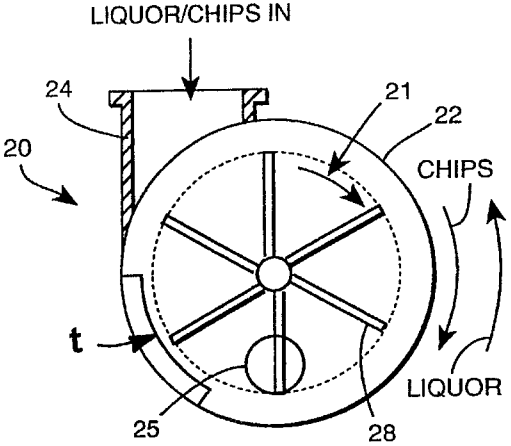
FIGS. 3 and 4 are schematic end and top views, respectively, of the submerged chip meter of FIG. 2.
Figure 4:
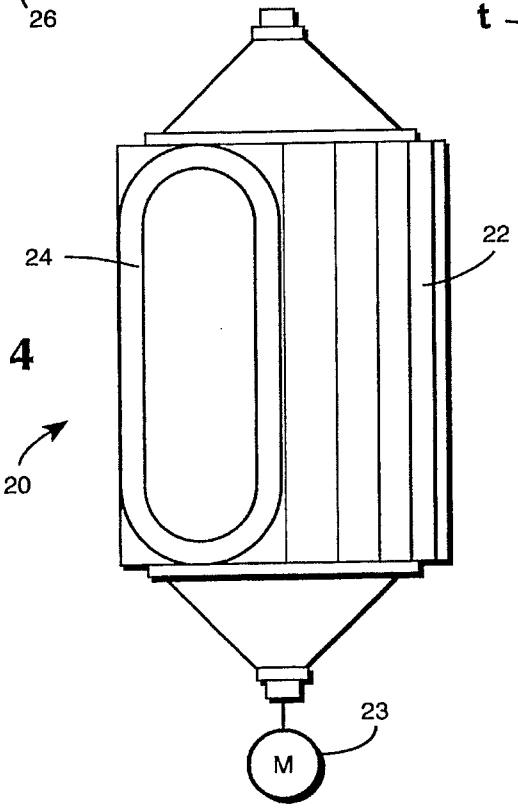
Figure 2:
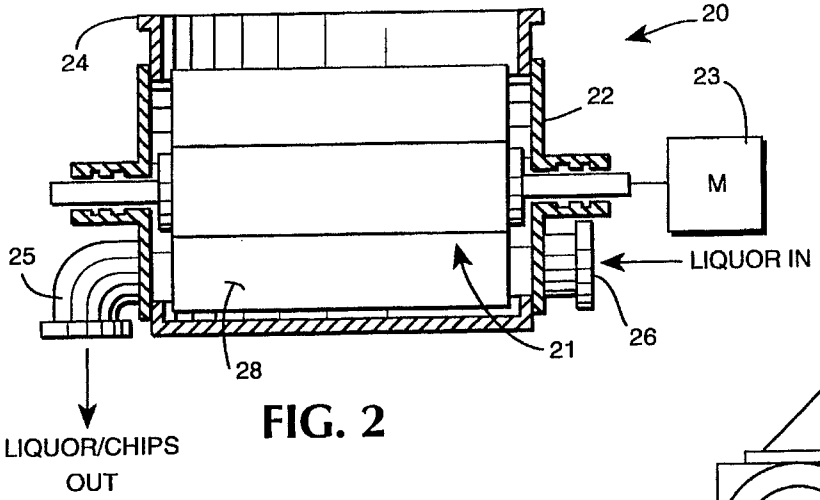
FIG. 2 is a side view, partly in cross-section and partly in elevation, of a submerged chip meter which may be used as the metering device in the system of FIG. 1.

The metering device 12 may be a conventional metering screw feeder (as seen at 19 in FIG. 5); a conventional chip meter, as sold by Kamyr, Inc. of Glens Falls, N.Y.; or a "submerged" chip meter 20 as shown in FIGS. 2–4. A submerged chip meter differs from a conventional chip meter in that it operates at least partially, if not totally, filled with liquor.

As shown in FIGS. 2–4, the submerged meter 20 may consist of a star-type rotor 21 mounted in a cylindrical housing 22 and driven by a variable-speed motor 23. The chips and liquor (if completely submerged) enter the inlet 24, which may be offset as shown, and are transferred by the rotating pockets of the rotor 21 in the clockwise direction shown. When a pocket is positioned adjacent the outlet 25, slurrying liquor, which enters an inlet 26 opposite the outlet, aids in discharging the slurry from the meter 20. Passage of chips back to the inlet 24 is minimized by tightly tolerancing the clearance between the tips of the impeller blades 28 of rotor 21 and the inside diameter of the feeder housing 22. FIG. 3 illustrates this narrow clearance "t" on the backside (around 7 to 9 o'clock in FIG. 3) of the meter 20. An open tolerance or clearance between the impeller blade 28 tips and housing 22 on the right side of the meter 20 permits liquor to flow past the chips counter-currently and maintain the liquor level, if desired, in the vessel above (e.g. steaming vessel 11).

The chip chute 13 and slurry pump 14 of FIG. 1 are conventional. The pump 14 pressurizes and transfers the slurry to a conventional high-pressure feeder (30 in FIG. 5), as sold by Kamyr, Inc. of Glens Falls, N.Y. The feeder (30) further pressurizes the slurry and transfers it to the inlet of a digester, either a continuous or batch digester.

The liquor level tank 15 of FIG. 1 is preferably a cylindrical (circular cross-section) vessel with a discharge outlet or opening 31 which directly communicates with inlet 16 of the slurry pump 14.

The feeding system shown in FIG. 1 may be pressurized (at superatmospheric pressure, e.g. 2+ bar) or may operate at atmospheric pressure. The atmospheric system is generally shown in solid line in FIG. 1. A pressurized system further includes a pressure isolating device, for example, a low-pressure feeder, somewhere in the system. For example, a pressure isolating device 32 can be located between the pretreatment vessel 11 and metering device 12 (as shown in dotted line in FIG. 1) or between the metering device 12 and the feed chute 13.

Also, when appropriate, the feed system 10 may employ a single-convergence outlet with side relief when a restriction is encountered. For example, such an outlet may be located on the outlet of the pretreatment vessel 11 discharging to the metering device 12, or such an outlet can be located on the outlet of the metering device 12 or feed chute 13.

Figure 5:
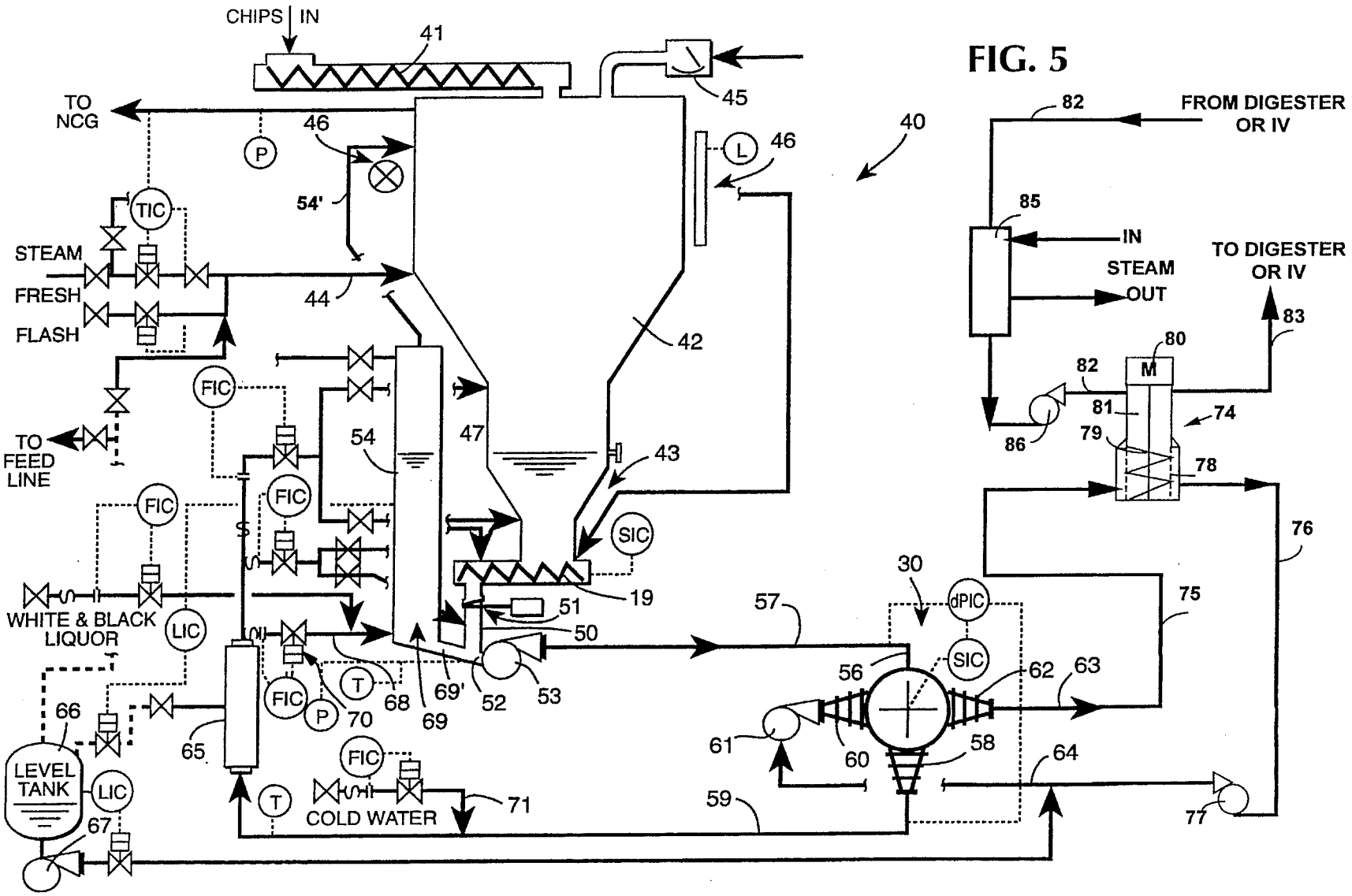
FIG. 5 is a side schematic view, in more detail than that of FIG. 1, showing an exemplary system according to the present invention and various interconnections thereto.

FIG. 5 shows a more detailed schematic of a typical installation of an exemplary feeding system 40 for a continuous digester. The incoming chips enter a transport screw 41 and are transported to the inlet of pressurized or unpressurized steaming vessel 42. The vessel 42 is a cylindrical vessel (e.g. generally circular in cross-section) which may have an outlet including a single-convergence transition with side relief, shown schematically at 43. Fresh or contaminated steam is introduced at one or more locations 44 in the vessel 42. This vessel 42 may include a conventional non-condensable gas relief and a vacuum relief or a vent 45. This vent 45 preferably includes a vent gate as disclosed in co-pending application Ser. No. 08/317,810 filed Oct. 4, 1994 now U.S. Pat. No. 5,547,546. The vessel 42 may also include a conventional gamma-radiation level detector 46 and temperature probe (not shown) which are used to detect the level of chips in the vessel 42.

As shown, this steaming vessel 42 may include a liquor level which is controlled by means of a conventional closed-loop level controller. Liquor may be added at various locations (e.g. 47) in the vessel 42 to control liquor level and to aid the discharge of chips from the vessel 42.

The steaming vessel 42 of FIG. 5 discharges to a conventional metering-type screw 19. The screw 19 is driven by a variable speed motor, the speed of which is controlled by the operator or is close-loop controlled to the level of chips in the steaming vessel 42 or chip chute 50. Steam and liquor may be added at various locations in the screw housing 19 as required.

The screw 19 discharges to the chip chute 50. The chute 50 may include a valve 51 which can be used to control the flow of chips but permits the passage of liquor. A valve element with a perforated restriction or plate can be used. The chute 50 discharges to the inlet 52 of the slurry pump 53.

The liquor level tank 54 is also shown in FIG. 5. As discussed above, the tank 54 provides a ready reservoir of liquor to the inlet 52 of the chip pump 53. This liquor aids the transfer of chips from the chute 50 to the inlet 52 of the pump 53. Since the liquor in the tank 54 is in direct communication with the liquor in the metering device 19 or steaming vessel 42, the liquor level in the liquor tank 54 regulates the liquor level in the feed system 40. The tank 54 may also include a vent 54' which discharges to the vessel 42.

The pump 53 discharges the slurry of comminuted cellulosic fibrous material in liquid (preferably cooking liquor such as white liquor) to the low pressure inlet 56 of the high pressure feeder 30, through a conduit 57 or like transfer means. The high pressure feeder 30 also includes a low pressure outlet 58 to which a recirculation line 59 is connected, a high pressure inlet 60 connected to a high pressure pump 61, and a high pressure outlet 62 connected to a conduit 63 to transfer slurry to the top of a continuous digester, or the like, with return liquid flowing in conduit 64 to the high pressure (top circulation) pump 61 as is conventional.

The recirculation line 59 is connected to a conventional in-line drainer 65, from which liquid flows to a conventional level tank 66, and from the tank 66 may be fed by the make up pump 67 to the line 64, or where else it is needed. The liquid passing through the drainer 65 (that is not being separated to the level tank 66) passes through a conduit 68 directly to the open bottom discharge 69 from the liquor tank 54, the opening 69 connected directly to the pump 52 inlet by the conduit 69'. A valve 70 may be provided in the conduit 68; the valve 70 should be of the type which cannot completely close as that may result in an undesirable or unsafe condition. As schematically illustrated in FIG. 5, it is preferred that the open discharge 69 from the liquor tank 54 be located slightly vertically above the pump 53 inlet 52.

In order to control the temperature of the liquor returned to the feed system 40 from the feeder 30, cold water may be added to line 59, as indicated at 71 in FIG. 5, or the liquor in line 59 may be passed through a conventional liquid cooler. The temperature is reduced sufficiently so that flashing of hot liquor does not occur in the high pressure feeder 30.

The chip feeding system, including the high pressure feeder 30, may require thermal isolation from the digester or impregnation vessel. This is illustrated schematically in FIG. 5, which also prevents flashing or "hammering" in the high pressure feeder 30 or slurry pump. The general concept of this temperature isolation is shown in U.S. Pat. No. 5,413,677.

For example, as illustrated in FIG. 5, liquid in line 63 from the high pressure feeder 30 is fed to a conventional inverted top separator 74, a circulation loop including the lines 75 and 76 and pump 77 being provided. The liquid in the circulation loop including the lines 75, 76 is at cool temperature, e.g. about 200°–250° F., so that flashing in high pressure feeder 30 or the like does not occur. Cooling water flow in line 71 may or may not be used.

Connected to the upper half of the inverted top separator 74 is another circulation loop. The inverted top separator includes a perforated cylindrical screen 78, screw 79, and motor 80 for rotating the screw 79, and a top section 81. Hot liquid (e.g. about 300°–325° F.) is fed to the top section 81 through the conduit 82, and the chip slurry—in which the cool liquor has now been replaced with hot liquor—passes in line 83 to the digester or the impregnation vessel (IV). The liquid returning from the digester or impregnation vessel in line 82 is heated (e.g. to about 300°–325° F.) in the heater 85 and then pumped by pump 86 to the top portion 80 of the inverted top separator 74.

Figure 6:
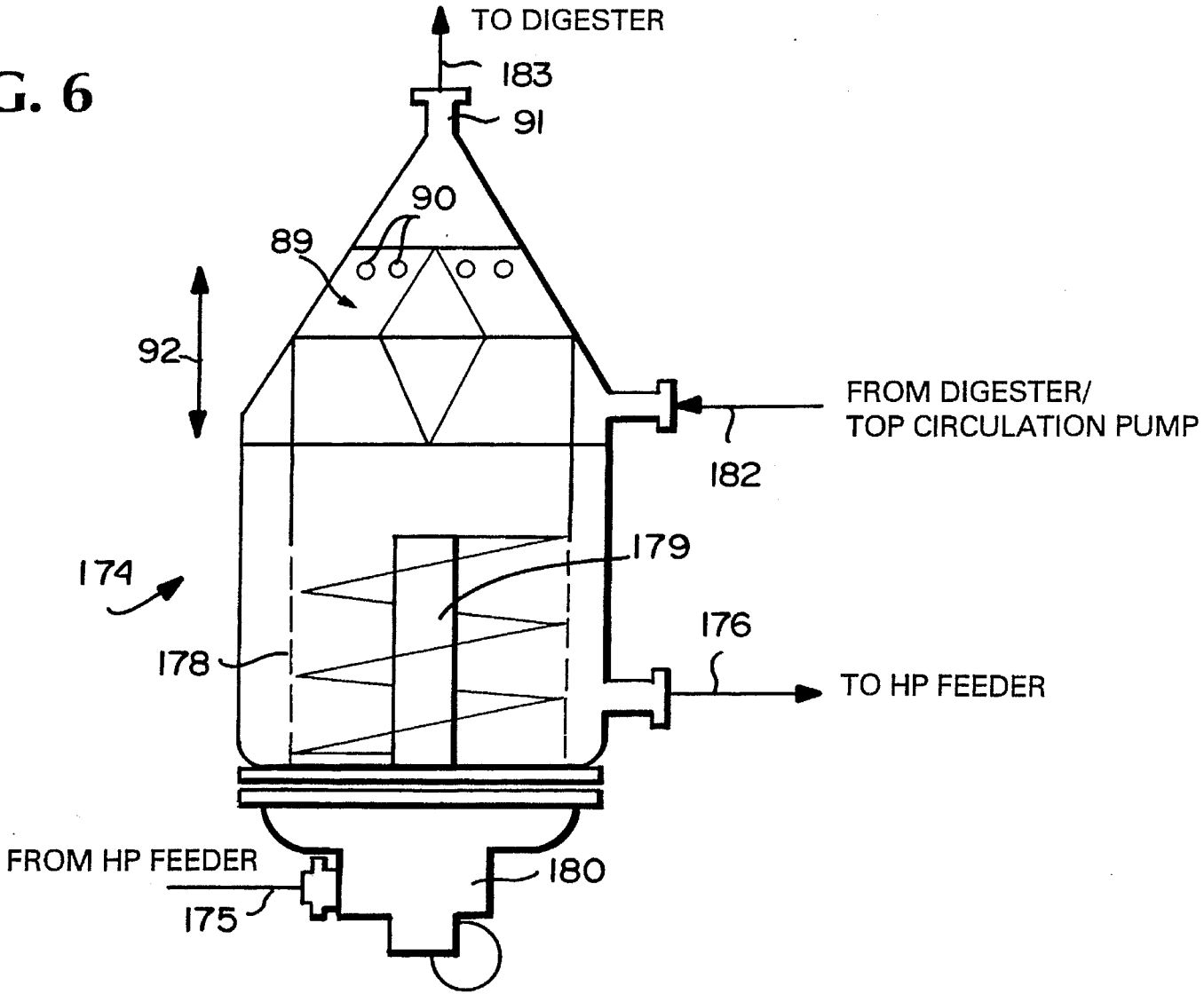
FIG. 6 is an alternative construction of the thermal separation device in the system of FIG. 5.

FIG. 6 shows an alternative construction that the top separator can take, the structure of FIG. 6 being nonconventional. In FIG. 6 structures comparable to those in FIG. 5 are illustrated by the same reference numeral only preceded by a "1".

The external top separator 174 includes an inlet line 175, an outlet line 176 to the high pressure feeder, an inlet line 182 from the digester top circulation, and an outlet 183 to the digester or impregnation vessel. The bottom portion of the device 174 includes a perforated cylindrical screen 178 and a screw 179 driven by a motor 180. However, instead of the chips slurry passing out of a side of the top portion of the separator (as illustrated for the separator 74 in FIG. 5), it passes out through the top, a single convergence with side relief structure 89 being provided, the structure 89 per se being generally as shown in U.S. Pat. No. 4,958,741 (the disclosure of which is hereby incorporated by reference herein), and such as sold commercially under the trademarks "Diamondback Hopper" and "Diamondback" by J. R. Johanson, Inc. of San Luis Obispo, Calif. and Ahlstrom Kamyr, Inc. of Glens Falls, N.Y. To facilitate discharge from the separator 174 dilution liquor inlets 90 may be provided, the pulp slurry ultimately passing out the outlet 91 in the top of the external separator 174. By varying the dimension 92, the residual time may be varied.

The liquors used in the feed system 40 may be conventional kraft white, black or green liquor, or sulfite liquor or soda liquor. These liquors may be of varying sulfidity but are preferably of high sulfide ion content. This liquor may also include additives such as anthraquinone, or its equivalents or derivatives, or any sulfide enhancing additives, such as polysulfide, added in vessel 11 or elsewhere.

It will thus be seen that according to the present invention an advantageous system and method are provided for feeding comminuted cellulosic fibrous material entrained in liquid to a high pressure feeder connected to a digester. The invention permits separate control of liquor volume and chip volume in a feed system in which the chips are pumped, and minimizes the effect of changes in liquid volume upon operation of the system. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent systems and methods.

What is claimed is:

1. A method of feeding a slurry of comminuted cellulosic fibrous material in liquid to a digester utilizing a pretreatment vessel, a high pressure feeder having a low pressure inlet, and a slurry pump having an inlet, comprising the steps of:

(a) pretreating the comminuted cellulosic fibrous material in the pretreatment vessel;

(b) metering the flow of comminuted cellulosic fibrous material from the pretreatment vessel;

(c) entraining the metered comminuted cellulosic fibrous material in liquid to form a slurry;

(d) feeding the slurry to the inlet to the slurry pump;

(e) providing a separate supply of liquid to the slurry pump inlet to facilitate the transfer of comminuted cellulosic fibrous material to the pump;

(f) transporting the slurry under the influence of the slurry pump to the low pressure inlet to the high pressure feeder; and (g) feeding the comminuted cellulosic fibrous material with the high pressure feeder to a digester.

2. A method as recited in claim 1 wherein step (e) is practiced by connecting an open bottom discharge from a substantially vertical liquid tank that is higher than the slurry pump inlet, directly to the slurry pump inlet.

3. A method as recited in claim 2 wherein the pretreatment vessel is a steaming vessel; and comprising the further step of maintaining a liquid level in the substantially vertical liquid tank, and providing an open connection between the vertical liquid tank open bottom discharge and the steaming vessel so as to provide the same liquid level in the steaming vessel.

4. A method as recited in claim 1 wherein steps (c) and (d) are practiced to entrain the comminuted cellulosic fibrous material in cooking liquor.

5. A method as recited in claim 1 wherein step (a) is practiced at least in part by steaming.

6. A system for feeding comminuted cellulosic material entrained in liquid to a high pressure feeder connected to a digester, comprising:

a vertical treatment vessel having a discharge at the bottom thereof;

a metering device connected to the discharge of said treatment vessel;

a generally vertical chute extending downwardly from said metering device;

a high pressure feeder connected to a digester;

a slurry pump for pumping a slurry of comminuted cellulosic material in liquid, said slurry pump having an inlet, and said pump connected to said high pressure feeder;

said chute operatively connected to said slurry pump inlet;

a substantially vertical liquor tank having a top and a bottom, said bottom including a discharge opening therein; and a conduit directly connecting said liquor tank discharge opening with said slurry pump inlet.

7. A system as recited in claim 6 wherein said discharge opening is above said pump inlet, said liquor tank is in direct communication with said chute, and through said chute said metering device and treatment vessel, through said discharge opening in said liquor tank bottom.

8. A system as recited in claim 7 further comprising means for maintaining a predetermined liquid level in said liquor tank, which in turn maintains a liquid level in said metering device and steaming vessel.

9. A system as recited in claim 8 wherein said metering device comprises a submerged chip meter.

10. A system as recited in claim 7 in combination with a high pressure feeder having a low pressure inlet, low pressure outlet, high pressure inlet connected to a high pressure pump, and high pressure outlet; and wherein said slurry pump is connected to said low pressure inlet of said high pressure feeder.

11. A system as recited in claim 10 further comprising an in-line drainer, a level tank, a valve that is always at least partially open, a first recirculation conduit connecting said low pressure outlet to said drainer, a second conduit connecting said drainer to said level tank so that liquid drained from said drainer passes into said level tank; and a third recirculation conduit connecting said drainer to said discharge opening at the bottom of said liquor tank.

12. A system as recited in claim 11 further comprising means for maintaining a predetermined liquid level in said liquor tank, which in turn maintains a liquid level in said metering device and treatment vessel.

13. A system as recited in claim 12 wherein said metering device comprises a submerged chip meter.

14. A system as recited in claim 7 wherein said treatment vessel comprises a steaming vessel having an outlet comprising a single convergence outlet with side relief.

15. A system as recited in claim 6 wherein said metering device comprises a metering screw.

16. A system as recited in claim 6 wherein said system is substantially at atmospheric pressure.

17. A system as recited in claim 6 wherein said treatment vessel comprises a steaming vessel; and further comprising an isolating device between said steaming vessel and said slurry pump for isolating said slurry pump from the atmosphere, and for maintaining said slurry pump at superatmospheric pressure.

18. A system as recited in claim 17 wherein said isolating device comprises a low pressure feeder.

19. A system as recited in claim 18 wherein said low pressure feeder is between said steaming vessel and said metering device.

20. A slurry feeding system for feeding a slurry of comminuted cellulosic fibrous material treatment system comprising:

a substantially vertical pretreatment vessel;

means for metering the flow of comminuted cellulosic fibrous material from the pretreatment vessel;

means for entraining the metered comminuted cellulosic fibrous material in liquid to form a slurry;

a slurry pump having an inlet;

means for feeding the slurry to the inlet to the slurry pump;

means providing a separate supply of liquid to the inlet to the slurry pump to facilitate the transfer of comminuted cellulosic fibrous material to the slurry pump to permit separate control of liquor and comminuted cellulosic material volumes, and to minimize the effect of changes in liquid volume upon operation;

a high pressure feeder having a low pressure inlet and a high pressure outlet;

a digester;

means for transporting the slurry under the influence of the slurry pump to the low pressure inlet of the high pressure feeder; and means for transporting the comminuted cellulosic fibrous material from the high pressure feeder to said digester.

21. A system as recited in claim 20 wherein said means for providing a separate supply of liquid comprises a substantially vertical liquid tank having an open bottom discharge that is higher than the slurry pump inlet, and connected directly to the slurry pump inlet.

* * * * *